US005322387A

United States Patent [19]

Heine et al.

[11] Patent Number: 5,322,387

[45] Date of Patent: Jun. 21, 1994

[54] WASTE WATER DRAINFIELD

[76] Inventors: Robert S. Heine, 5005 Country Manor, Imperial, Mo. 63052; Michael V. Heine, 1403 Wells Ave., Webster Groves, Mo. 63119

[21] Appl. No.: 894,948

[22] Filed: Jun. 8, 1992

[51] Int. Cl.[5] ..... E03F 11/00

[52] U.S. Cl. ..... 405/36; 405/39; 405/43; 405/51; 137/561 A; 210/519; 210/921

[58] Field of Search ..... 405/36, 39, 43, 51; 210/170, 519, 521, 921, 532.1, 532.2; 137/561 A

[56] References Cited

U.S. PATENT DOCUMENTS

| | | | |
|---|---|---|---|
| 3,919,848 | 11/1975 | Sullivan | 210/170 X |
| 4,298,470 | 11/1981 | Stallings | 210/170 |
| 4,578,188 | 3/1986 | Cousino | 210/170 |
| 4,605,501 | 8/1986 | Tyson | 137/561 A X |
| 4,614,584 | 9/1986 | Di Duca | 210/532.2 X |
| 4,789,487 | 12/1988 | Wallace | 210/170 X |
| 4,838,731 | 6/1989 | Gavin | 405/36 X |

*Primary Examiner*—Dennis L. Taylor
*Assistant Examiner*—John Ricci
*Attorney, Agent, or Firm*—Armstrong, Teasdale, Schlafly & Davis

[57] ABSTRACT

A waste water drainfield for a sewerage disposal system of the type comprising a plurality of conventional absorption trenches includes a distribution device at each absorption trench for separating waste water into two components of preselected proportions; at least one distribution pipe for each distribution device for temporarily storing a quantity of waste water and/or for distributing the waste water to its respective absorption trench; and distribution lines connecting the distribution devices in series, each distribution device delivering one of the components to its distribution pipes for temporary storage and distribution to its respective absorption trench, and delivering the other of the components to the next distribution device via a distribution line. A method of distributing waste water from a sewerage disposal system to a plurality of conventional absorption trenches comprises the steps of distributing the waste water to the trenches in parallel by delivering the waste water flow to each absorption trench in series, and at each absorption trench separating a preselected proportion of the waste water flow based on the design capacity of that particular absorption trench and the design capacity of the remaining absorption trenches, delivering the preselected proportion of the waste water flow to the trench and delivering the remainder of the flow to the next absorption trench.

12 Claims, 5 Drawing Sheets

WASTE WATER DRAINFIELD

BACKGROUND AND SUMMARY OF THE INVENTION

This invention relates to an improved waste water drainfield for a sewerage disposal system.

Sewerage disposal systems, such as septic tanks, are usually provided with a drainfield to assist in dispersing waste water. As shown in FIG. 1, and described below, these drainfields typically comprise a plurality of identical absorption trenches that are connected in series. Waste water is disbursed by distributing it to the trenches, where it percolates through the soil. However waste water distribution in a conventional system is uneven. The waste water is typically conducted to the first trench in the series. Since the flow of waste water is generally greater than the percolation capacity of the first trench, the waste water level rises until it spills over to the second trench. Again the flow of waste water, particularly at peak periods, is generally greater than the percolation capacity of the first and second trenches, and the waste water level rises in the second trench as well, and from time to time spills over to the third trench. Thus, in a conventional system, the full percolation capacity of the trenches is not realized until most of the trenches are filled to capacity.

As alluded to above, conventional waste water systems are typically designed for an average waste water flow rate, i.e. the percolation capacity of the trenches in the system is designed to meet the average waste water flow rate. However, as illustrated in FIG. 3, actual water flow can vary significantly from the average flow rate. Unless they are substantially oversized, conventional drainfields have difficulty handling peak waste water flow rates, and there is a risk that the waste water will overflow the trenches, breaking the ground surface, in what is known as "hydraulic failure" or more commonly a "blow out". This condition is exacerbated by rain or flooding, which wets the soil, and thus reduces the water storage capacity of the soil. Moreover, as the trenches fill up, there is a continuous hydrostatic head from the septic tank through the trenches to the last trench. This continuous, unbroken hydrostatic head increases the likelihood that waste water will break the surface of the ground.

Some conventional waste water systems employ a distribution box to divide the waste water flow directly to absorption trenches. However, such distribution boxes are prone to failure. Even if the distribution boxes operate properly, such a system is still subject to overload during peak flow rates, and the trenches are still subjected to a substantial hydraulic head that cause waste water to overflow and break the surface of the ground.

Generally, the waste water drainfield of the present invention includes a plurality of conventional absorption trenches, and a distribution system for distributing waste water to the trenches. This distribution system includes at least one distribution pipe at each of the absorption trenches for temporarily storing a quantity of waste water and for distributing the waste water to its respective absorption trench. There is a distribution device at each of the absorption trenches except one, for separating waste water into first and second flow components of preselected proportions. A plurality of distribution lines connect the distribution devices in series. A distribution line also connects the last distribution device in the series to the distribution pipe for the absorption trench without a distribution device. Each of the distribution devices delivers the first flow component to the distribution pipe for its respective trench for temporary storage and/or distribution. Ea oh of the distribution devices delivers the second flow component via the distribution lines to the next distribution device in the series, except the last distribution device in the series, which delivers the second component to the distribution pipe for the absorption trench without a distribution device.

The distribution pipes provide storage capacity so that the drainfield can a accommodate peak water flow rates without water breaking the surface of the ground. Thus, the drainfield does not have to be oversized to accommodate peak flow rates. Because the trenches are connected in parallel, rather than in series, water distribution through the drainfield is more even. Moreover, the hydrostatic head is interrupted by the distribution devices and thus the hydrostatic head on the trenches is reduced. The distribution devices allow control over the amount of waste water delivered to each trench. This allows the trench size to be varied. This flexibility in trench size makes it easier to design a system for a given site.

These and other features and advantages will be in part apparent, and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

The Prior Art

Figure 1:
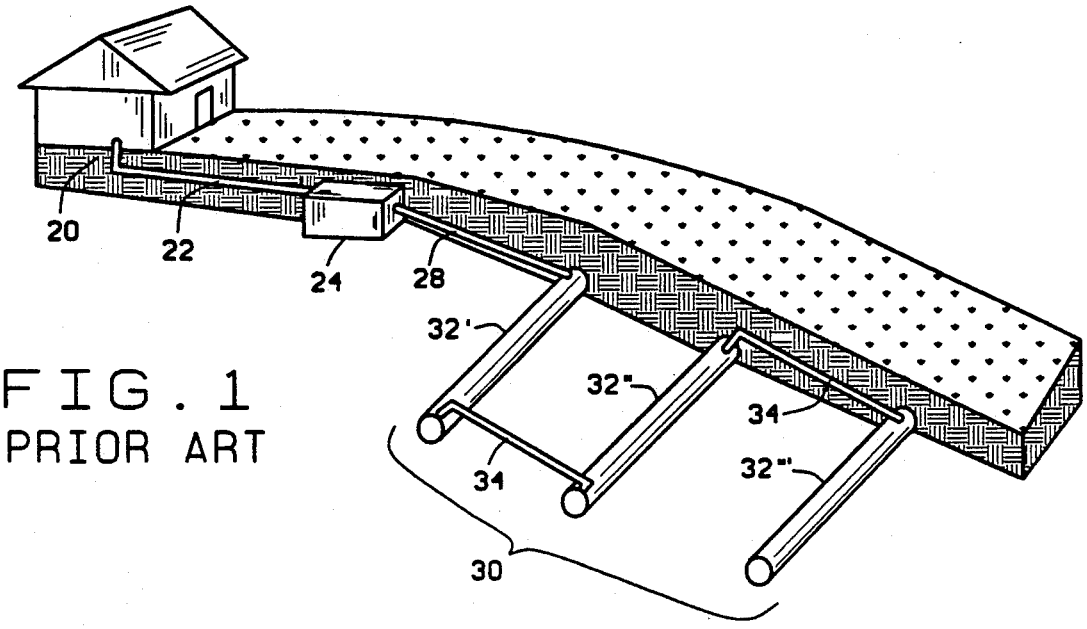
FIG. 1 PRIOR ART
FIG. 1 is a diagram of a conventional prior art drainfield.

A conventional prior art drainfield is shown schematically in FIG. 1. As shown in FIG. 1, sewerage exits a house 20 in a sewer pipe 22, and is conducted to a septic tank 24 where solid waste is separated from the waste water. The waste water exits the septic tank 24 and passes through a pipe 28 to a drainfield 30 of conventional trenches 32, which are connected in series by pipes 34. The trenches 32 may be either conventional gravel trenches or graveless pipe trenches. Waste water flows through the trenches 32 of the conventional drainfield 30 in series.

Figure 2:
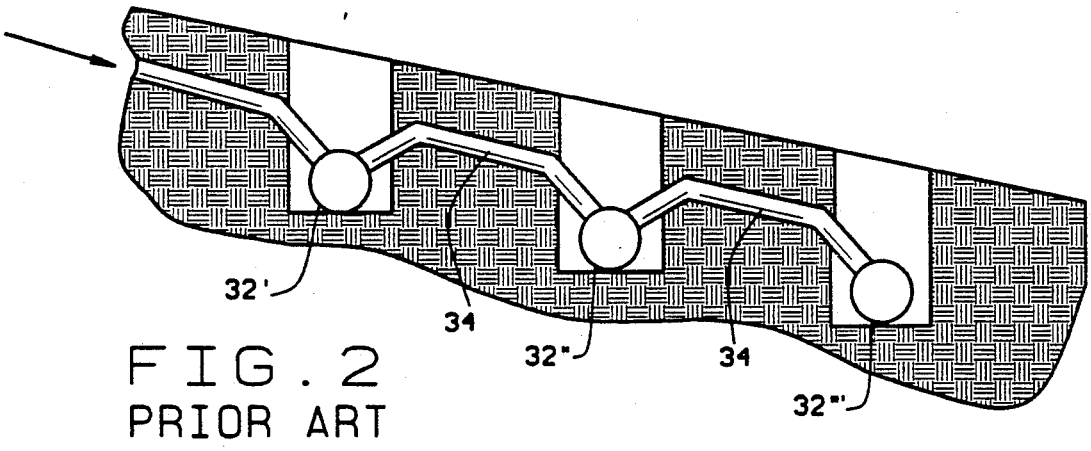
FIG. 2 PRIOR ART
FIG. 2 is a diagram of the absorption trenches of the drainfield shown in FIG. 1.

As shown in FIG. 2, because the flow of waste water is generally greater than the percolation capacity of the first trench 32', waste water quickly fills the first trench 32', and spills over to the second trench 32" via pipe 34. Because the flow of waste water, particularly at peak periods, is generally greater than the percolation capacity of the first and second trenches, the waste water level rises in the second trench 32", as well, and from time to time spills over to the third trench 32"', Thus, because of the series connection, the full percolation capacity of the conventional drainfield is not realized until most of the trenches are filled to capacity.

Figure 3:
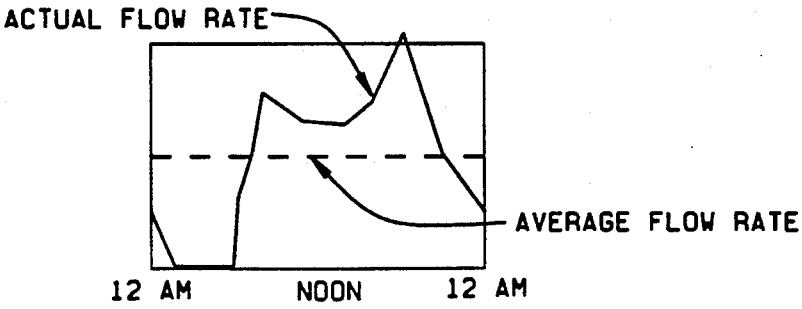
FIG. 3 is a graph of a waste water flow rate for a typical household.

The FIG. 3 graph illustrates how actual flow rates (solid line) varies from the average flow rate (dashed line), which is the value typically used in designing a drainfield. It is apparent that peak flow rate can substantially exceed the average flow rate, and in soils with a slow percolation rate, particularly after the soil has been saturated by rains or flooding , the peak flow rates can cause waste water to break the surface in conventional systems.

Even when waste water is distributed directly to each of the trenches, for example through a distribution box, conventional trenches have difficulty accommodating peak waste water flow rates, and a substantial hydrostatic head can exist in the trenches. Moreover with this type of parallel waste water scheme, each of the trenches must be made the same length due to the limitations of existing distribution boxes. This in creases the difficulty of designing a system for a particular site.

The Preferred Embodiment

Figure 4A:
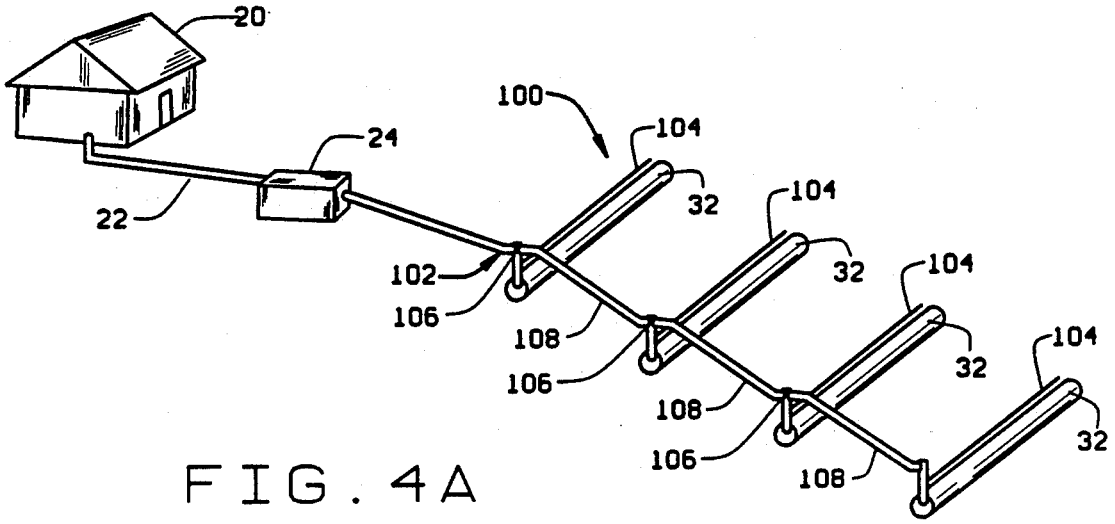
FIG. 4A is a diagram of a drainfield constructed according to the principles of this invention.
Figure 4B:
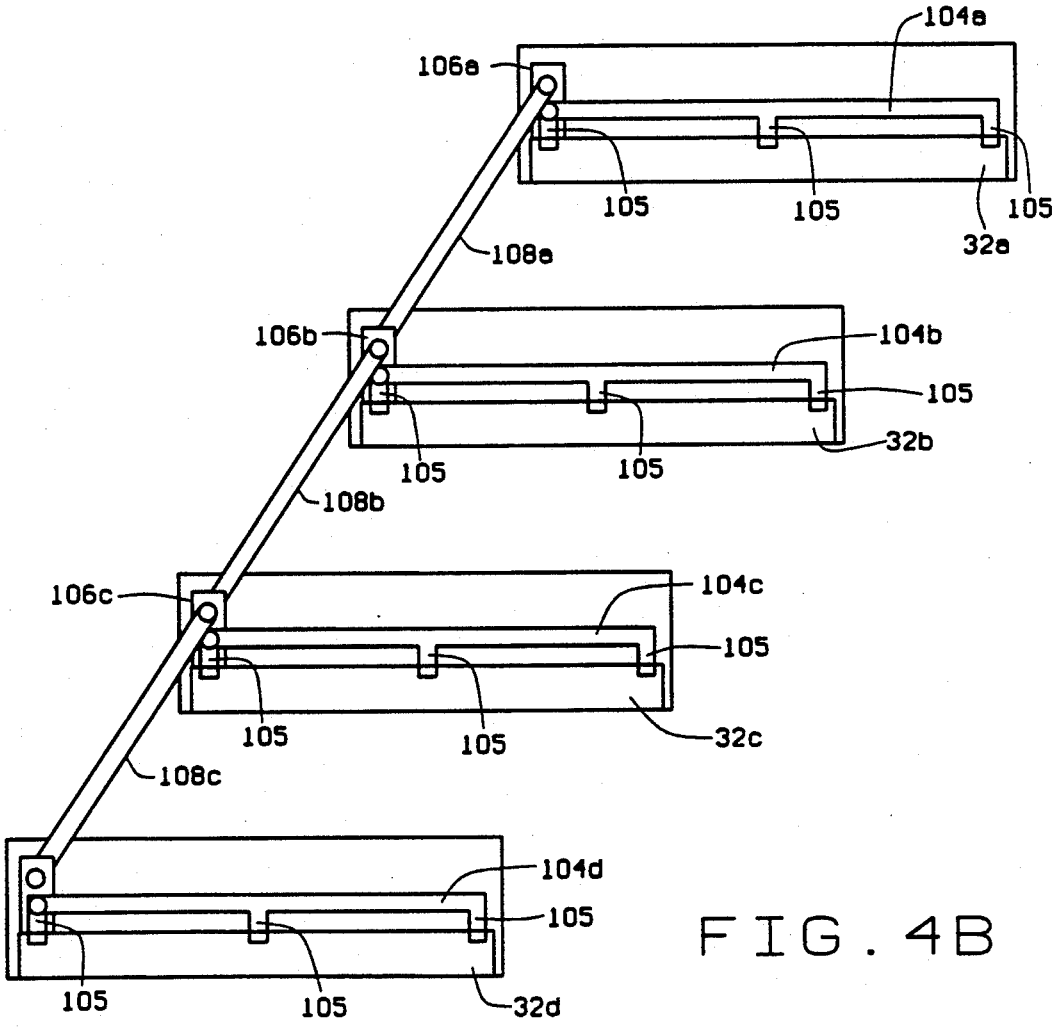
FIG. 4B is a schematic diagram of the drainfield shown in FIG. 4A.

A waste water drainfield 100 constructed according to the principles of the present invention is shown in FIG. 4A. The drainfield 100, like conventional drainfield designs, comprises a plurality of conventional trenches 32. These trenches may be, for example, gravel trenches or graveless pipe trenches. The drainfield 100 further comprises a distribution system 102. This distribution system 102 comprises at least one distribution pipe 104 at each of the absorption trenches 32 for temporarily storing a quantity of waste water and/or for distributing the waste water to its respective absorption trench. As shown in FIG. 4B, one or more risers 105 connect each distribution pipe 104 to its respective trench. For example, there may be three such risers 105, one at each end of the trench, and one generally intermediate the ends of the trenches. However, since waste water readily flows in the trenches, only one such riser is necessary.

There is a distribution device 106 at each of the absorption trenches 32 except one. The distribution devices 106 are adapted for separating waste water into first and second flow components of preselected proportions. A plurality of distribution lines 108 connect the distribution devices 106 in series. A distribution line 108 also connects the last distribution device 106 in the series to the distribution pipe 104 for the absorption trench without a distribution device. Thus connected, each of the distribution devices 106 delivers its first flow component to the distribution pipe 104 for its respective trench for temporary storage and distribution. There is preferably a vertical drop between the separation device 106 and the level of the distribution device, to provide a break in the hydrostatic head on the trenches 32, thereby reducing the hydrostatic pressure on the waste water in the trenches. Each of the distribution devices delivers its second flow component via the distribution 108 lines to the next distribution device in the series. The last distribution device in the series delivers its second flow component to the distribution pipe for the absorption trench without a distribution device.

The distribution devices 106 in the system are typically not identical, but rather each separates the waste water delivered to it into first and second components of differing preselected relative proportions, depending upon the position of the distribution device in the series, and on the trench's size and absorption capacity. The construction of a distribution device 106 particularly adapted for use in drainfields according to the present invention is illustrated in FIGS. 5–10.

Figure 5:
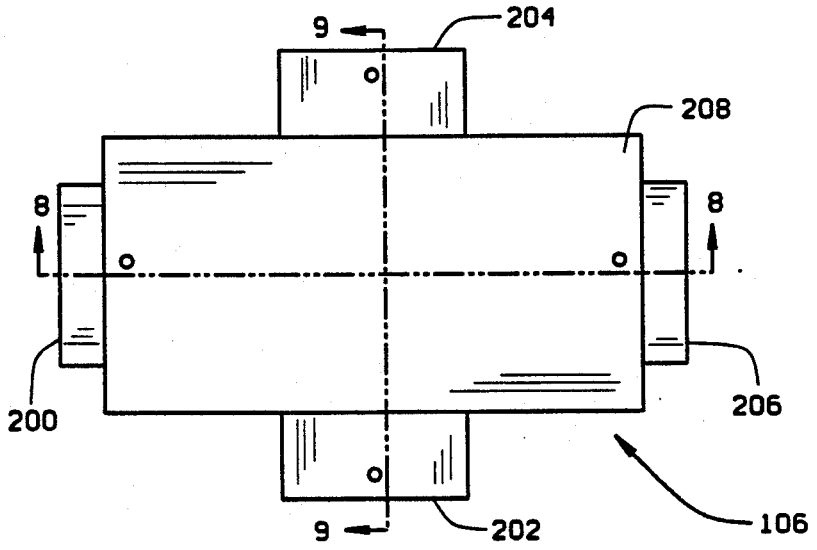
FIG. 5 is a top plan view of a distribution device particularly adapted for use in the drainfield of the present invention.

As shown in the FIG. 5 top plan view, the distribution device 106 has an inlet 200 , at the left end of the device, for receiving waste water, and outlets 202 and 204, on the front and back of the device, respectively, for delivering the first component of the flow to distribution pipes 104, and an outlet 206 at the right end of the device for delivering the second component of flow to a connector line 108. The entire distribution device 106 can be conveniently and inexpensively made from plastic, such as PVC.

Figure 6:
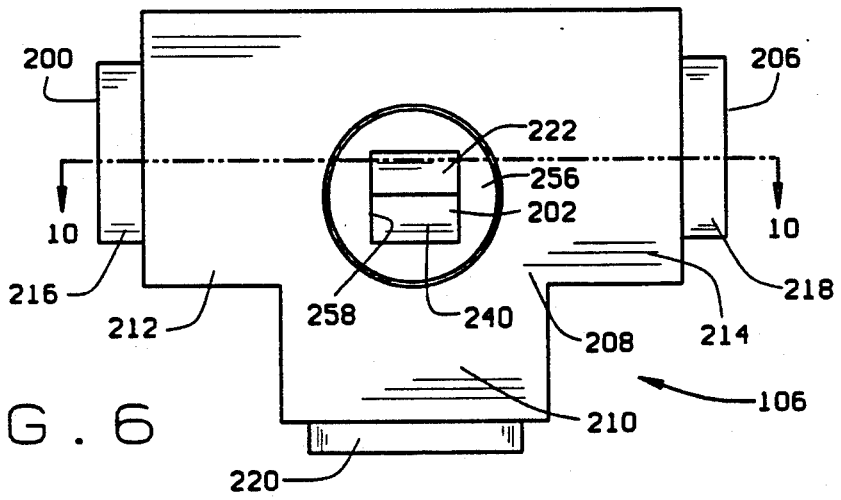
FIG. 6 is a front elevation view of the distribution device.
Figure 7:
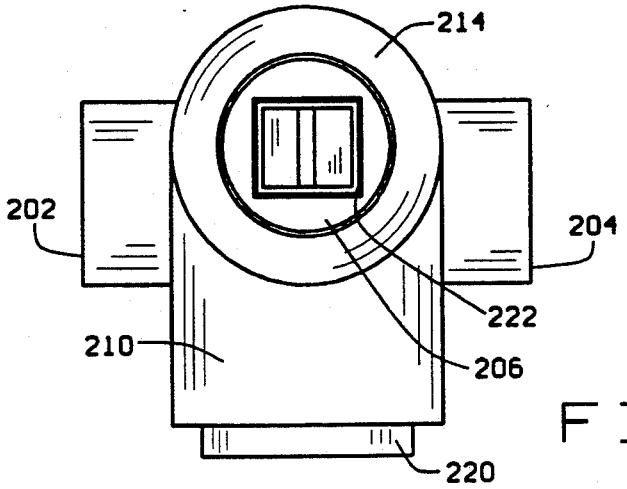
FIG. 7 is a right side elevation view of the distribution device.
Figure 8:
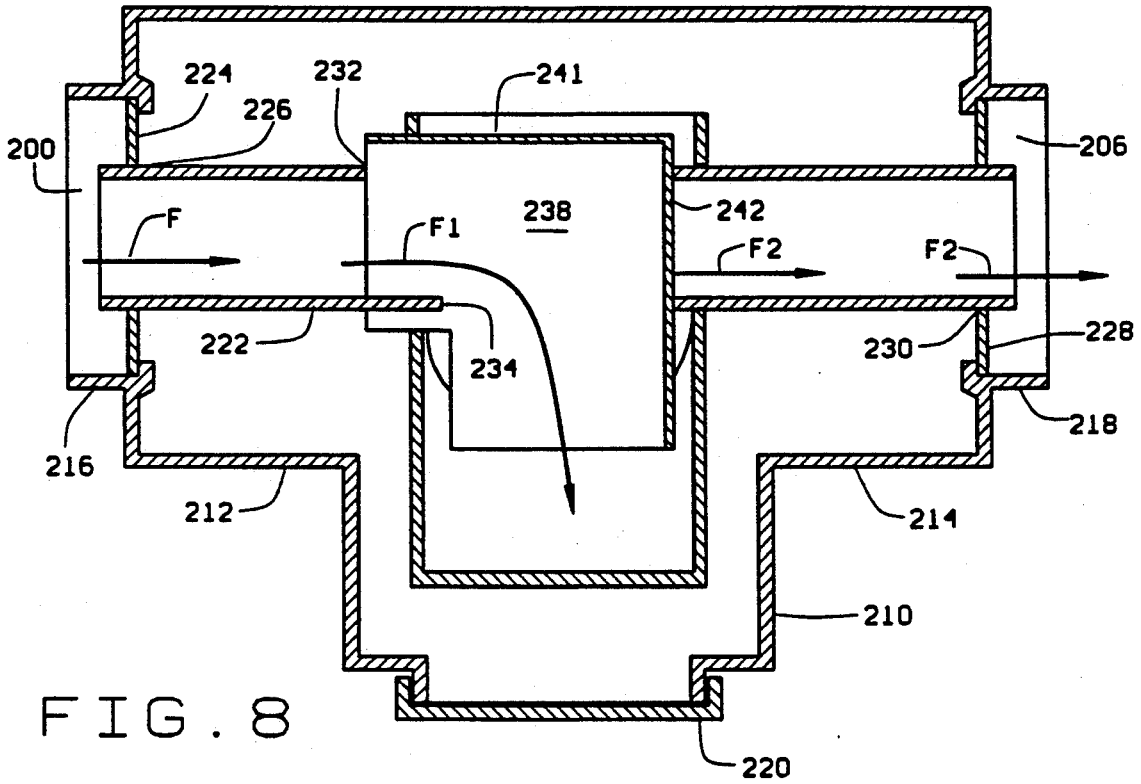
FIG. 8 is a vertical longitudinal cross-sectional view of the distribution device, taken along the plane of line 8—8 in FIG. 5.

As shown in the FIG. 6 front elevation view, the distribution device comprises a generally T-shaped housing 208, with a stem 210 and arms 212 and 214. The stem 210, and the arms 212 and 214, preferably have a circular cross-section. There is a circular collar 216 extending from the end of the arm 212, for making a connection to the inlet 200 of the device 106. There is a circular collar 218 extending from the end of arm 214, for making a ozone action to the outlet 206 of the device. The bottom of the stem 210 is preferably closed with a cap 220.

A passageway 222 extends longitudinally through the top of the "T", between the inlet 200 and the outlet 206. The passageway 222 has a rectangular cross-section, and as shown in the Figures, the cross section is preferably square. A circular plate 224 having a square opening 226 for receiving the passageway 222, is secured in the collar 2 16 to hold passageway 222 in place and channel the waste water delivered to the device 106 through the passageway 222. A circular plate 228, having a square opening 230 for receiving the passageway 222, is secured in the collar 218 to hold the passageway 222 in place, and to ensure that the only waste water exiting outlet 206 comes from the passageway 222.

The long, narrow configuration of the passageway 222, establishes a smooth, relatively non-turbulent flow therethrough. There is a generally U-shaped opening 232 in the top of the passageway 222. There is also an opening 234, in the bottom of the passageway 222, aligned with the opening 232. These openings are positioned generally in the center of the passageway 222, both lengthwise and widthwise. A deflector 236, extends through the aligned openings 232 and 234 in the passageway 222. The deflector 236 has generally parallel sidewalls 238 and 240. A top 241 extends between the top edges of the sidewalls 238 and 240, above the top of the passageway 222. A back wall 242 extends between the back (or downstream) edges of the sidewalls 238 and 240. The deflector 236 has an opening 244 defined by the front (or upstream) edges of the sidewalls 238 and 240. The opening 244 faces the flow through the passageway 222. The deflector 236 captures a portion of the flow through the passageway 222, generally proportional to the cross-sectional area of the opening 244 compared to the cross-sectional area of the passageway 222. The waste water diverted by the deflector 236 passes down through the opening 234 in the bottom of the passageway 222, into a chamber 246.

Figure 9:
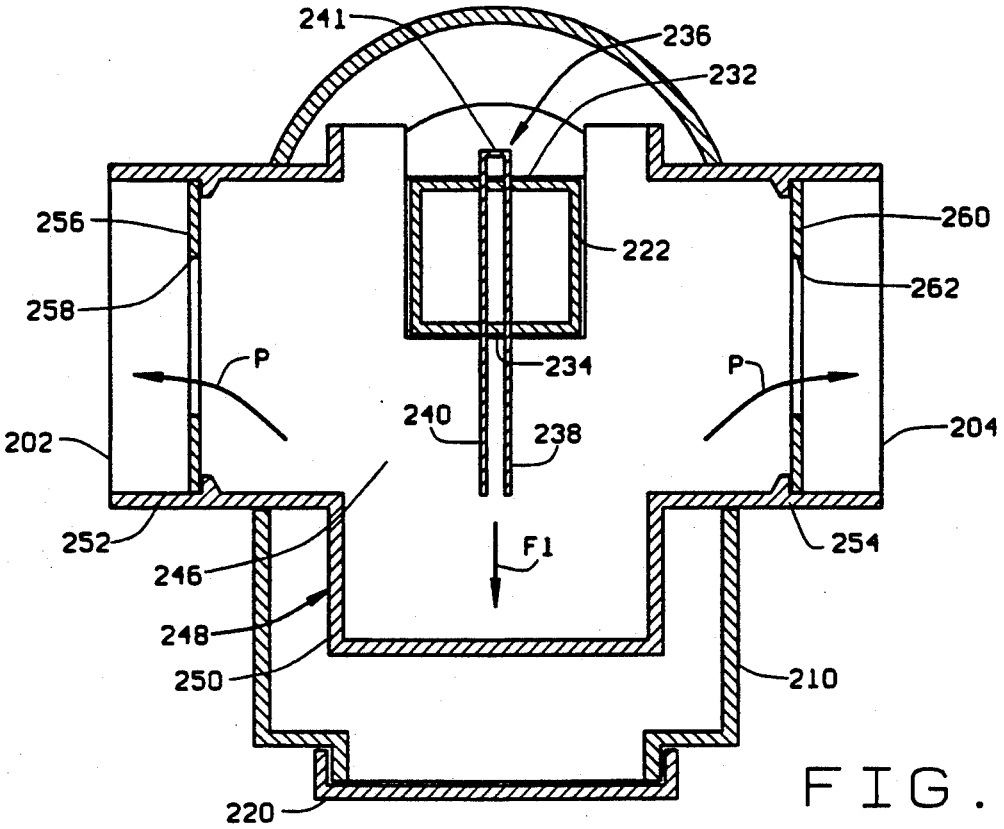
FIG. 9 is a vertical transverse cross-sectional view of the distribution device, taken along the plane of line 9—9 in FIG. 5.

As best shown in the transverse vertical cross-sectional view of FIG. 9, the chamber 246 is generally T-shaped, defined by a T-shaped housing 248 with a stem 250, and left and right arms 252 and 254, which extend transversely with respect to T-shaped housing 208. The arms 252 and 254 extend through the front and rear of the housing 208, respectively, forming the outlets 202 and 204, respectively. There is a weir plate 256, having an opening 258 therethrough, in the arm 252. Similarly there is a weir plate 260, having an opening 262 therethrough, in the arm 254. The weir plates, and the sizes, shapes, and positions of their respective openings 258 and 262, determine the distribution of waste water to the pipes 104 via outlets 202 and 204. The weir plates can be adjusted to accommodate difference in the sizes of the pipes 104 connected to the distribution device, or differences in the percolation capacity of the soil surrounding the pipes. Of course, one of the outlets can be complete closed so that the waste water is directed to a single distribution pipe 104.

In operation, waste water F is delivered to inlet 200 of the device 106. The waste water flows through passageway 222 long enough to establish a substantially smooth, non-turbulent flow. The waste water stream through the passageway 222 en counters the deflector 236, a first portion of the flow $F_1$ is captured by the deflector, diverted out of the passageway 222, down to chamber 246. The vertical drop provides a gap so that the waste water in the pipe 104 is not subjected to a continuous hydrostatic head from the rest of the distribution system. There, the first portion P of the flow $F_1$ is distributed to the outlets 202 and 204. A second portion of the flow $F_2$ passes around the deflector 236 and out outlet 206. There the first portion P of the flow $F_1$ is distributed to the outlets 202 and 204.

Figure 10:
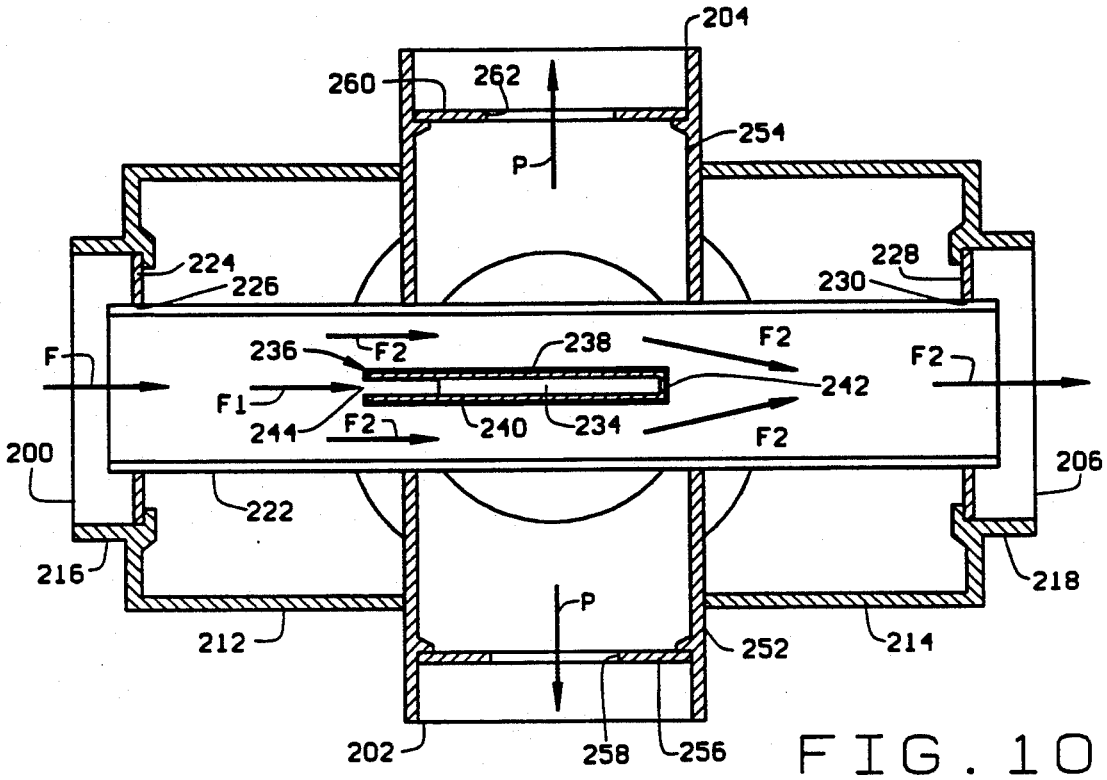
FIG. 10 is a horizontal cross-sectional view of the distribution device taken along the plane of line 10—10 in FIG. 6.
Figure 11:
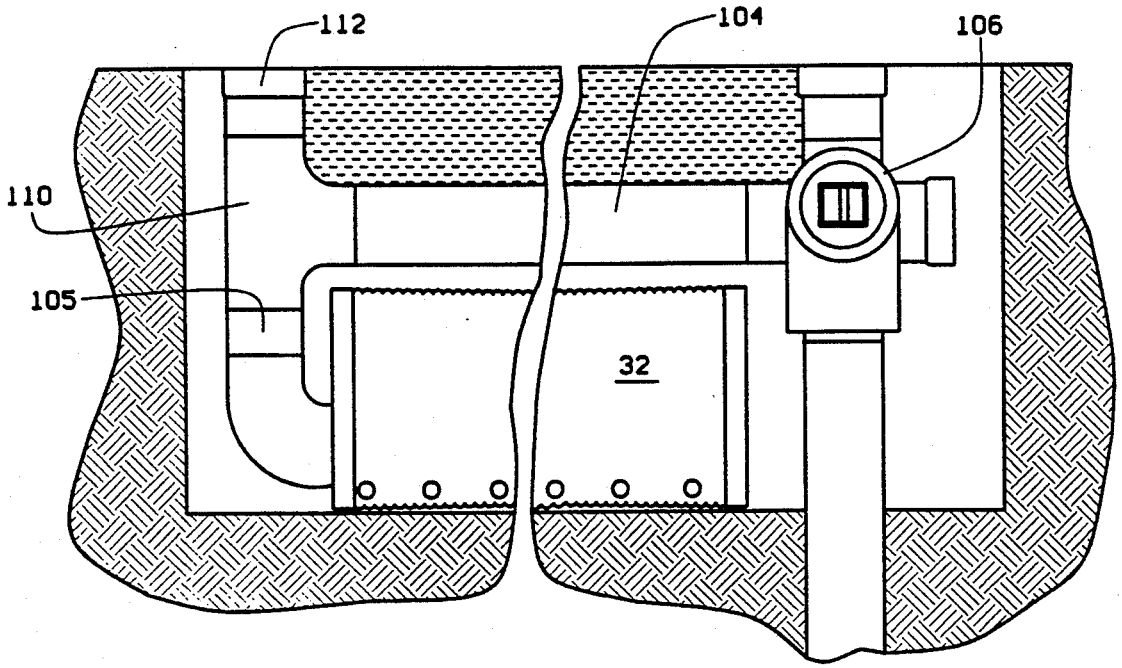
FIG. 11 is a longitudinal vertical cross-sectional view of the device.

From the outlets 202 and 204, the waste water passes to distribution pipes 104 , where it can be temporarily stored, if necessary. The waste water gradually passes through the risers 105 into the absorption trench 32, as shown in FIG. 11. As also shown in FIG. 10, an inspection pipe 110, with a cap 112, can be provided at the end of each distribution pipe adjacent the end of the trenches 32, to monitor the waste water levels in the trenches.

OPERATION

The operation of the drainfield 100 is best understood in connection with the FIG. 4B. A quantity of waste water passes from a septic tank or other treatment system to the drainfield. The waste water reaches the separator device 106*a*, where it is separated into two components. The first component is delivered to the distribution pipe 104*a*, where it is stored temporarily, and it eventually passes through risers 105 to the trench 32*a*. The second component is delivered via connecting line 108*a* to the next separator device 106*b*. Assuming for purposes of this illustration that the total flow of waste water is 12 gallons, 3 gallons might be separated out as the first component to be delivered to distribution pipe 104*a*, and the remaining 9 gallons would pass as the second component to distribution device 106*b*, in a ratio of 1:3. The waste water reaches the separator device 106*b*, where it is separated into two components. The first component is delivered to the distribution pipe 104*b*, where it is stored temporarily, and it eventually passes through branches 105 to the trench 32*b*. The second component is delivered via connecting line 108*b* to the next separator device 106*c*. Assuming for purposes of this illustration, a flow of 9 gallons into separator device 106*b*, 3 gallons might be separated out as the first component to be delivered to distribution pipe 104*b*, and the remaining 6 gallons would pass as the second component to distribution device 106*c*, in a ratio of 1:2. The waste water reaches the separator device 106*c*, where it is separated into two components. The first component is delivered to the distribution pipe 104*c*, where it is stored temporarily, and it eventually passes through risers 105. The second component is delivered via connecting line 108*c* to the last distribution pipe 104*d*. Assuming for purposes of this illustration that there is a flow of 6 gallons into separator device 106*c*, 3 gallons might be separated out as the first component to be delivered to distribution pipe 104*c*, and the remaining 3 gallons would pass as the second component to distribution pipe 104*d*, in a ratio of 1:1.

Thus the waste water is properly distributed to each trench. In addition to providing even distribution along the trench, the distribution pipe provides temporary storage of waste water to accommodate peak flows, thereby preventing waste water from blowing through the surface. Moreover, each successive trench is isolated from the preceding trenches by a distribution device, thereby preventing large hydrostatic heads from building up on the latter trenches. The distribution devices allow accurate separation and distribution of the waste water to the various trenches. This ability to control the distribution allows the designer to vary trench size, facilitating the design process.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limited sense.

What is claimed is:

1. An improved waste water drainfield for a sewerage disposal system of the type comprising a plurality of conventional absorption trenches, the improvement comprising a distribution system which comprises:

a distribution device at each absorption trench for separating waste water into two components of preselected proportions;

at least one distribution pipe for each distribution device for temporarily storing a quantity of waste water and for distributing the waste water to its respective absorption trench;

and distribution lines connecting the distribution devices in series, each distribution device delivering one of the components to its distribution pipes for temporary storage and distribution to its respective absorption trench, and delivering the other of the components to the next distribution device via a distribution line.

2. An improved waste water drainfield for a sewerage disposal system of the type comprising a plurality of conventional absorption trenches, the improvement comprising a distribution system which comprises:

at least one distribution pipe at each of the absorption trenches for temporarily storing a quantity of waste water and for distributing the waste water to its respective absorption trench;

a distribution device , at each of the absorption trenches except one, for separating waste water into first and second flow components of preselected proportions; and a plurality of distribution lines, the lines connecting the distribution devices in series, and connecting the last distribution device in the series to the distribution pipe for the absorption trench without a distribution device, each of the distribution devices delivering the first flow components to the distribution pipes for its respective trench for temporary storage and distribution, and each of the distribution devices delivering the second flow component via the distribution lines to the next distribution device in the series, the last distribution device in the series delivering the second component to the distribution pipe for the absorption trench without a distribution device.

3. The improved waste water drainfield according to claim 2 wherein each separation device comprises a channel for waste water flow, a flow splitter having an opening facing upstream in the channel for diverting a portion of the flow, proportional to the relative cross sectional areas of the channel and the splitter opening, through the bottom of the channel.

4. The improved waste water drainfield according to claim 3 wherein the separation device further comprises a chamber below the channel for delivering the flow diverted by the splitter to at least one distribution pipe.

5. An improved waste water drainfield for a sewerage disposal system of the type comprising a plurality of conventional absorption trenches, the improvement comprising a distribution system which comprises:

at least one distribution pipe at each of the absorption trenches for temporarily storing a quantity of waste water and for distributing the waste water to its respective absorption trench;

a distribution device, at each of the absorption trenches except one, for separating waste water into first and second flow components of preselected proportions each separation device comprising a channel for waste water flow, a flow splitter having an opening facing upstream in the channel for diverting a portion of the flow, proportional to the relative cross sectional areas of the channel and the splitter opening, through the bottom of the channel, and a chamber below the channel for delivering the flow diverted by he splitter to at least one distribution pipe; and a plurality of distribution lines, the lines connecting the distribution device in series, and connecting the last distribution device in the series to the distribution pipe for the absorption trench without a distribution device, each of the distribution devices delivering the first flow components to the distribution pipes for its respective trench for temporary storage and distribution, and each of the distribution devices delivering the second flow component via the distribution lines to the next distribution device in the series, the last distribution device in the series delivering the second component to the distribution pipe for the absorption trench without a distribution device; the chamber of at least one of the separation devices having at least two openings of different sizes to deliver different amounts of waste water to at least two distribution pipes.

6. A distribution device for use in a waste water drainfield to separate waste water delivered to the distribution device into first and second components of predetermined proportions, the device comprising:

a chamber;

at least one outlet from the chamber for the first flow component;

an inlet for receiving the waste water;

and outlet for the second flow component a channel extending from the inlet to the outlet for the second flow component, the channel being positioned vertically above the chamber;

an opening in the bottom of the channel;

a deflector in the channel for diverting a first component of the waste water flow in the channel down through the opening in the bottom of the channel into the chamber where it can pass through the at least one outlet for the first component, while allowing a second component to continue to flow through the channel and out the outlet for the second component.

7. An improved method of distributing waste water from a sewerage disposal system to a plurality of conventional absorption trenches, the improvement comprising the steps of:

distributing waste water to each of the trenches in parallel by separating the waste water flow at each of the absorption trenches but the last into first and second components of preselected proportions, and delivering the first component to the absorption trench, and passing the second component on to the next absorption trench.

8. The improved method of distributing waste water according to claim 7, wherein the step of delivering the first component to the absorption trench comprises delivering the waste water to a temporary storage device capable of storing surges in waste water flow, and distributing the waste water to the absorption trench from the temporary storage device.

9. An improved method of distributing waste water from a sewerage disposal system to a plurality of conventional absorption trenches, the improvement comprising the steps of: distributing waste water to each of the trenches in parallel by separating the waste water flow at each of the absorption trenches but the last into first and second components of preselected proportions based upon the capacity of the current trench and the remaining trenches, and delivering the first component to the current absorption trench, and passing the second component on to the next absorption trench.

10. The improved method of distributing waste water according to claim 9, wherein the step of delivering the first component to the absorption trench comprises delivering the waste water to a temporary storage device capable of storing surges in waste water flow, and distributing the waste water to the absorption trench from the temporary storage device.

11. An improved method of distributing waste water from a sewerage disposal system to a plurality of conventional absorption trenches, the improvement comprising the steps of:

distributing the waste water to the trenches in parallel by delivering a flow of the waste water to each absorption trench in series, and at each absorption trench separating a preselected proportion of the waste water flow based on the design capacity of that particular absorption trench and the design capacity of the remaining absorption trenches, delivering the preselected proportion of the waste water flow to the trench and delivering the remainder of the flow to the next absorption trench.

12. The improved method of distributing waste water according to claim 11, wherein the step of delivering the preselected proportion of the flow to the absorption trench comprises delivering the waste water to a temporary storage device capable of storing surges in waste water flow, and distributing the waste water to the absorption trench from the temporary storage device.

* * * * *